US007497265B2

(12) United States Patent
Ross et al.

(10) Patent No.: US 7,497,265 B2
(45) Date of Patent: Mar. 3, 2009

(54) RECLOSABLE MECHANICAL ANNULAR FLOW VALVE

(75) Inventors: Richard J. Ross, Houston, TX (US); Dewayne M. Turner, Tomball, TX (US)

(73) Assignee: BJ Services Company, Houston, TX (US)

( * ) Notice: Subject to any disclaimer, the term of this patent is extended or adjusted under 35 U.S.C. 154(b) by 120 days.

(21) Appl. No.: 11/061,714

(22) Filed: Feb. 18, 2005

(65) Prior Publication Data

US 2006/0185852 A1 Aug. 24, 2006

(51) Int. Cl.
*E21B 34/14* (2006.01)

(52) U.S. Cl. ..... 166/332.1; 166/332.4; 166/334.1

(58) Field of Classification Search ..... 166/332.1, 166/332.4, 334.1, 373, 386, 387, 236, 166
See application file for complete search history.

(56) References Cited

U.S. PATENT DOCUMENTS

| | | | | |
|---|---|---|---|---|
| 5,263,683 | A * | 11/1993 | Wong | 251/145 |
| 6,382,319 | B1 * | 5/2002 | Hill et al. | 166/278 |
| 2002/0112862 | A1 * | 8/2002 | Patel | 166/386 |
| 2003/0178198 | A1 * | 9/2003 | Turner et al. | 166/313 |
| 2004/0045709 | A1 * | 3/2004 | Zuklic et al. | 166/278 |

* cited by examiner

*Primary Examiner*—Jennifer H Gay
*Assistant Examiner*—Daniel P Stephenson
(74) *Attorney, Agent, or Firm*—Zarian Midgley & Johnson PLLC

(57) ABSTRACT

A mechanical flow control device is provided that allows flow of production fluids along an annular path and across an valve body. A sliding sealing member can be mechanically transitioned between an opened flow position and a closed flow position as desired. The mechanical flow control device may be combined with one or more interventionless flow control devices.

17 Claims, 8 Drawing Sheets

RECLOSABLE MECHANICAL ANNULAR FLOW VALVE

CROSS REFERENCE TO RELATED APPLICATIONS

This application claims the benefit of U.S. patent application Ser. No. 10/364,941, filed on Feb. 12, 2003, which claims the benefit of U.S. patent application Ser. No. 10/004,956, filed on Dec. 5, 2001, and issued as U.S. Pat. No. 6,772,440, which claims the benefit of U.S. Provisional Application Ser. No. 60/251,293, filed on Dec. 5, 2000. This application also claims the benefit of U.S. patent application Ser. No. 09/378,384, filed on Aug. 20, 1999, and issued as U.S. Pat. No. 6,397,949, which claims the benefit of U.S. Provisional Application Ser. No. 60/097,449, filed on Aug. 21, 1998.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

This disclosure relates generally to a device for isolating production from a well zone, and more particularly to a reclosable mechanical annular flow valve.

2. Description of the Related Art

It is often times desirable to produce oil and/or gas from multiple production zones in a single subterranean well. Industry has developed numerous isolation devices, valves and other flow mechanisms to allow production from multiple zones with or without commingling the production fluids downhole.

One such device is referred to as an annular flow valve and permits well flow between the annulus formed between two structures, such as an inner and outer housing. An example of an hydraulically actuated, or interventionless, annular flow valve is disclosed and claimed in U.S. Pat. No. 6,722,440. This valve allows the operator to interventionless open the annular flow path once, but it does not allow the operator to reclose the annular flow path after interventionless opening.

The present invention is directed to a reclosable mechanical annular flow valve that may be used alone or in conjunction with an interventionless flow device.

BRIEF SUMMARY OF THE INVENTION

One aspect of the invention provides a flow control device for an oil or gas well that comprises an outer housing, an inner conduit disposed within the outer housing and fixed relative thereto, a flow path that is at least partially defined by an annulus between the outer housing and the inner conduit, at least one flow port disposed along the flow path for communicating flow along the flow path when the port is open and preventing flow along the flow path when the port is closed, a sealing member disposed within the device and adjacent the at least one flow port, the sealing member having at least two positions relative to the at least one port including an open position in which the sealing member does not prevent flow through the at least one port and a closed position in which the sealing member prevents flow through the at least one port; and a tool profile disposed on the sealing member for engaging a corresponding profile on a service tool for changing the sealing member from its opened to its closed position and vice versa.

Another aspect of the invention provides an interventionless and mechanical flow control assembly for an oil or gas well having unlimited open and close cycles comprising an outer housing, an inner conduit disposed within the outer housing and fixed relative thereto, a first flow path at least partially defined by an annulus between the outer housing and the inner conduit, at least one flow port disposed along the first flow path for communicating flow along the first flow path when the port is open and preventing flow along the first flow path when the port is closed, a sealing member disposed within the device and adjacent the at least one flow port, the sealing member having at least two positions relative to the at least one port including an open position in which the sealing member does not prevent flow through the at least one port and a closed position in which the sealing member prevents flow through the at least one port, a tool profile disposed on the sealing member for engaging a corresponding profile on a service tool for changing the sealing member from its open to its closed position and vice versa, and an interventionless flow control device coupled to the outer housing and comprising a second flow path in communication with first flow path and a valve element disposed within the second flow path, the valve element having at least an opened and a closed position, such that fluid flowing along the first path can flow along the second flow path when the valve element is opened and cannot flow along the second flow path when the valve element is closed, the interventionless device adapted to interventionlessly open the second flow path in response to well pressure.

BRIEF DESCRIPTION OF THE SEVERAL VIEWS OF THE DRAWINGS

The manner and process of making and using the present inventions may be understood by reading the following detailed description of particular embodiments that utilize the present inventions and by referring to the corresponding drawings, wherein like parts in each of the several figures are identified by the same reference characters, and which are briefly described as follows.

Figure 1:
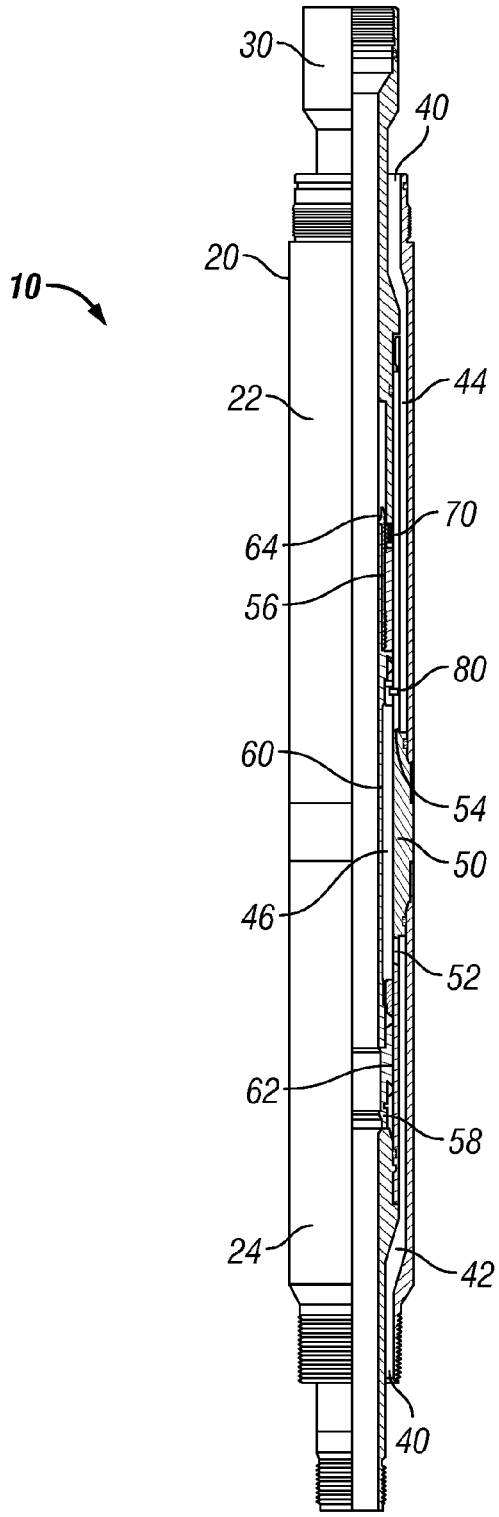
FIG. 1 illustrates one embodiment of a reclosable valve utilizing the present inventions.

While the inventions disclosed herein are susceptible to various modifications and alternative forms, only a few specific embodiments have been shown by way of example in the drawings and the detailed description below. The figures and detailed descriptions of these specific embodiments are not intended to limit the breadth or scope of the inventive concepts or the appended claims in any manner. Rather, the figures and detailed written descriptions are provided to enable a person of ordinary skill in the art to make and use the present inventions.

DETAILED DESCRIPTION

One or more illustrative embodiments incorporating the inventions disclosed herein are presented below. Not all features of an actual implementation are described or shown in this application for the sake of clarity. It is understood that in the development of an actual embodiment incorporating the present inventions, numerous implementation-specific decisions must be made to achieve the developer's goals, such as compliance with system-related, business-related and other constraints, which vary by implementation and from time to time. While a developer's efforts might be complex and time-consuming, such efforts would be, nevertheless, a routine undertaking for those of ordinary skill the art having benefit of this disclosure.

For purposes of this disclosure, Applicant hereby incorporates by reference as if fully set forth herein, for any and all purposes, the complete disclosure of U.S. Pat. No. 6,397,949 entitled "Method and Apparatus for Production Using a Pressure Actuated Circulating Valve"; U.S. Pat. No. 6,722,440, entitled Multi-Zone Completion String and Methods for Multi-Zone Completions; and U.S. application Ser. No. 10/364,941 entitled "Double Pin Radial Flow Valve." (Pub. No. 2003/0221839A1).

In general terms, Applicant has created a mechanical flow control device that may be mechanically opened and closed repeatedly, such as by a wireline- or coiled tubing-conveyed tools. More specifically, the mechanical flow control device may be an annular flow valve comprising an outer housing and an inner conduit. An annular flow path may be disposed between the housing and the conduit and a valve element may be disposed in the flow path. A sealing member may be slidably disposed in the device such that in one position the flow path through the device is open and in another position, the flow path is sealed closed.

Turning now to a specific embodiment of a reclosable mechanical flow control device, utilizing the present inventions, FIG. 1 shows a reclosable valve 10, such as an annular flow valve. The reclosable valve 10 comprises an outer housing 20 and an inner conduit or string 30. The down hole portion of the valve 10 may comprise a double pin arrangement as shown in FIG. 1. The outer housing 20 may comprise multiple portions or segments and, as shown in FIG. 1, the preferred embodiment comprises an upper housing segment 22 and a lower housing segment 24.

Disposed between the outer housing 20 and the inner string 30 is an annular flow path 40. Disposed within the flow path 40 is valve body 50. In the embodiment illustrated in FIG. 1, the valve body 50 is adapted to join upper housing segment 22 and lower housing segment 24 to form outer housing 20. Valve body 50 also comprises a plurality of lower flow ports 52 and a plurality of upper flow ports 54. The preferred embodiment presently described comprises about 5 or 6 upper flow parts 54 and about 5 or 6 lower flow parts 52. It is preferred that the flow area through both the lower flow ports 52 through and the upper flow ports 54 be greater than the flow area through the lower flow path 42 or the upper flow path 44 in order to minimize any pressure drop experienced by redirecting the flow of well fluids. It will be appreciated that in the open condition, well fluids are allowed to flow into the lower annular flow path 42 through the lower flow ports 52, through the diverted flow path 46, through the upper flow ports 54 and into the upper annular flow path 44.

Disposed within the reclosable valve 10 is a sealing member 60, such as an internal sleeve, which spans upper and lower flow ports 54, 52, thereby creating the diverted flow path 46. The internal sleeve 60 comprises a sealing surface 62, which is adapted to seal or close lower flow ports 52. The internal sleeve 60 is adapted to slide longitudinally relative to the reclosable valve 10. In the embodiment illustrated in figure 1, the internal sleeve 60 can move between at least two positions: an open position in which well fluids are allowed to flow through the reclosable valve 10 and a closed position in which well fluids from below the valve 10 are not permitted to flow through annular flow path 40 above the lower flow ports 52. The internal sleeve 60 also comprises a tool profile 64 adjacent the up hole end of the sleeve 60. It will be appreciated that the tool profile 64 is adapted to engage a corresponding profile on a service tool (not shown) for physically transitioning the reclosable valve 10 from its opened to its closed condition and vice versa.

The closable valve 10 also comprises a retaining mechanism 70, which is adapted to retain the internal sleeve 60 in the opened position, the closed position, or both positions. In the embodiment illustrated in FIG. 1, the retaining mechanism 70 is comprised of two portions 72, 74, one of which is located on the internal sleeve 60 and another portion of which is located on the inner string 30. The presently preferred retaining mechanism 70 comprises a friction enhancing structure, such as the interlocking ribs illustrated in FIG. 5. It will be appreciated that while the well fluid pressure in the annular flow path 40 will not cause the annular sleeve to move, the mass flow or momentum of well fluids may urge internal sleeve 60 to move in the direction of flow. In FIG. 1, such movement would tend to close the reclosable valve 10. Usually, it will be undesirable for the valve 10 to prematurely close itself Thus, it is preferred that the retaining mechanism 70 should be constructed to retain the internal sleeve 60 in the open condition regardless of well fluid pressure, flow rates or other downhole conditions.

In use, reclosable valve 10 may be placed in the well string above, for example, a gravel-packed production zone. If the reclosable valve 10 is used by itself, the internal sleeve 60 will usually be releasably fixed to the inner conduit 30 in the closed condition, such as by one or more shear pins 80. When production is desired from that particular formation, a wire line- or coiled tubing-conveyed service tool (not shown) can be lowered down hole to engage tool profile 64 on sealing member 60. In the embodiment shown in FIG. 1, manipulation of the service tool will cause the internal sleeve 60 to slide in a down hole direction thereby opening lower flow ports 52 and allowing well fluids to flow along the annular flow path 40 in reclosable valve 10.

Figure 2:
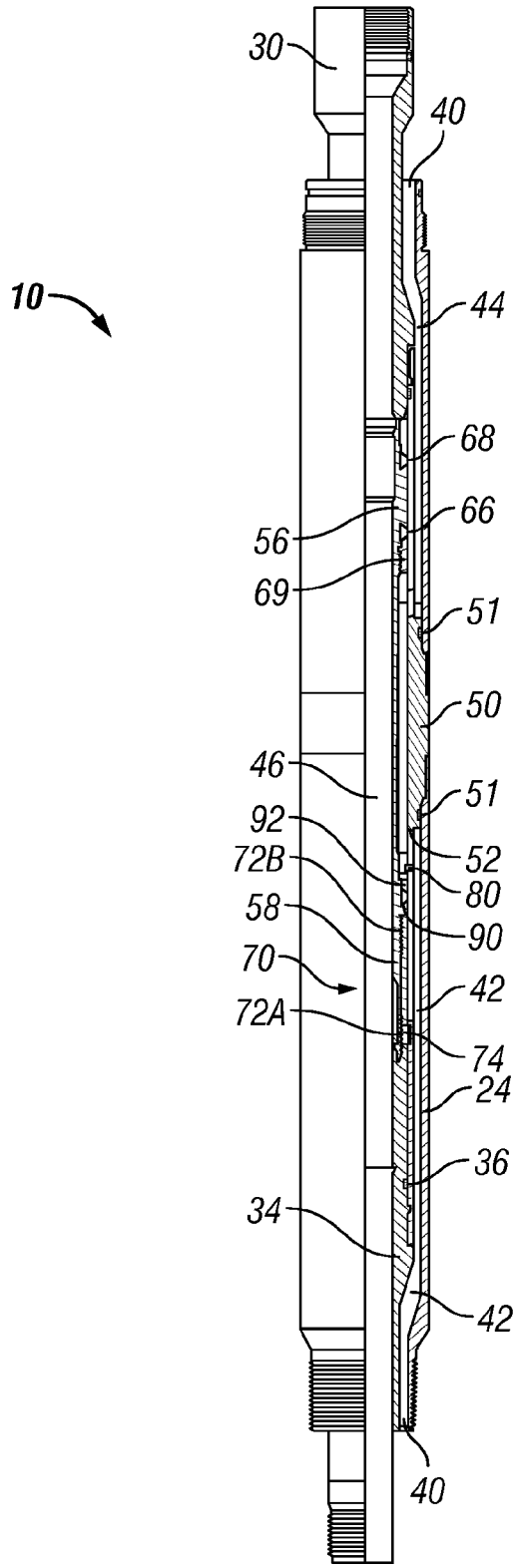
FIG. 2 illustrates another embodiment of a redo sable valve utilizing the present inventions.

An alternate embodiment of a reclosable valve 10 is illustrated in FIG. 2. FIG. 2 shows a reclosable valve 10 substantially similar to that illustrated in FIG. 1 and described above except that the orientation of the internal sleeve 60 has been modified so that well fluid pressure and flow rate will tend to force the internal sleeve 60 to the open position, rather than the closed position. It will be appreciated that in the embodiment illustrated in FIG. 2, the retaining mechanism 70 in conjunction with well fluid momentum will tend to retain the internal sleeve 60 in the opened position.

Figure 3:
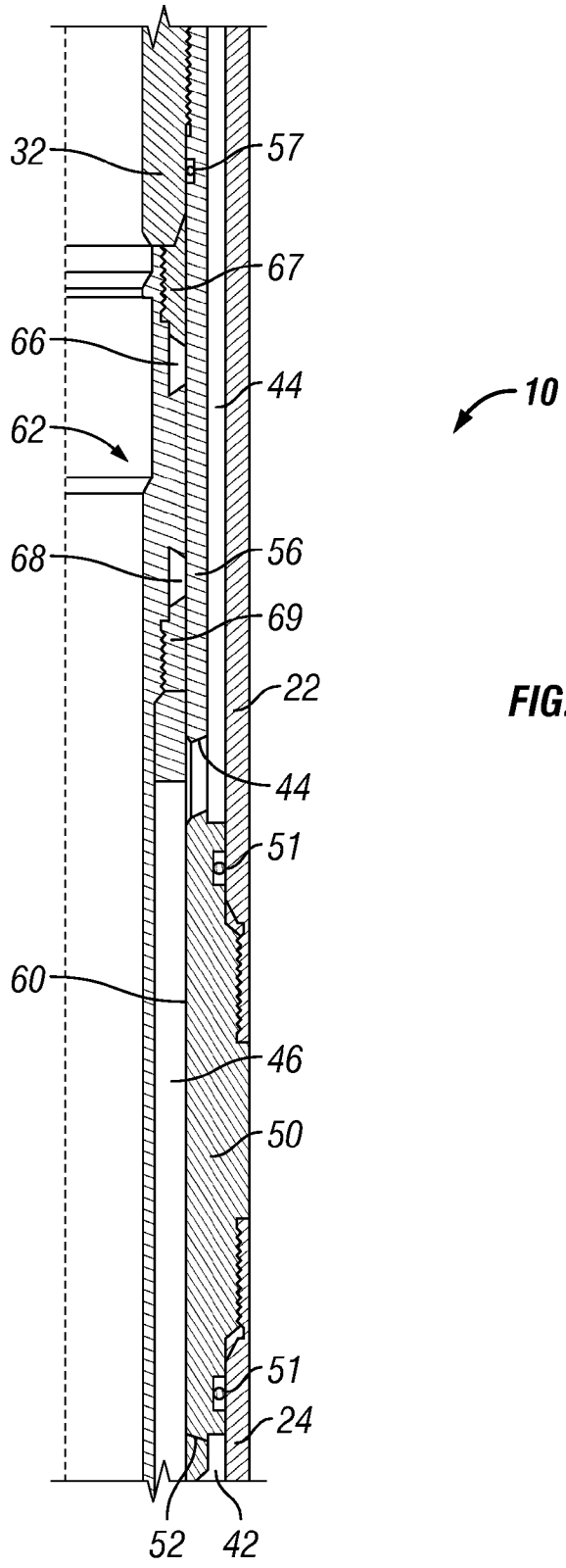
FIG. 3 illustrates a sliding seal that may be used with a reclosable valve.

Turning now to a more detailed description of sealing surface 62 on sealing member 60, FIG. 3 illustrates sealing surface 62 of the valve 10 in FIG. 2 to comprise first and second sliding seal rings 66, 68. In the closed condition (not shown), upper flow port 44 is spanned by first and second seal rings 66 and 68. Seal ring 66 and 68 may be fabricated from any of a well-known number of materials such as elastomers, PEEK PEKK, PTFE and/or reinforced PTFE depending on the well conditions expected to be encountered by the valve 10. In the embodiment presently described, the seal rings 66 and 68 are fabricated from PEEK and are held in position on sealing surface 62 by seal retainers 67, 69. Also illustrated in FIG. 3 is a portion of inner conduit 30, which is shown to comprise an upper sub 32 and a valve body extension 56. A seal 57, such as an elastomer, may be used to seal the valve body extension 56 to the upper sub 32. Similarly, upper housing segment 22 is shown sealed to valve body 50 by seals 51.

Figure 4:
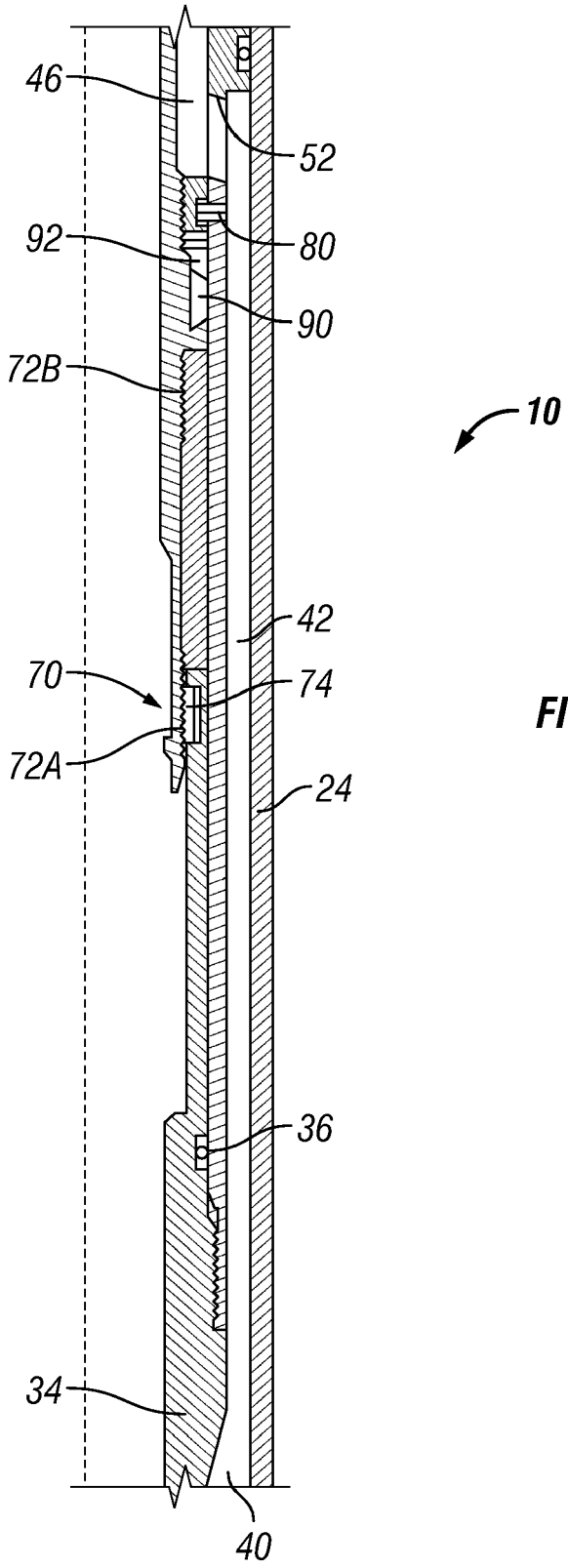
FIG. 4 illustrates a retention mechanism that may be with a reclosable valve.

FIG. 4 provides additional illustration of the retaining mechanism 70 and an additional sliding seal 90. In this embodiment, the retaining mechanism 70 is disposed at the end of the internal sleeve 60 opposite the sealing surface 62. The first portion 72 of the mechanism 70 is disposed adjacent the end of the sleeve 60 and faces the interface with inner conduit 30 (or 34). The second portion 74 of the mechanism 70 is disposed adjacent the inner conduit 30, and preferably on lower sub 34. As shown in FIG. 4, the retaining mechanism 70 retains the sleeve 60 in the open position when portions 72*a* and 74 are engaged and retains the sleeve 60 in the closed position when portions 72*b* and 74 are engaged.

Figure 5:
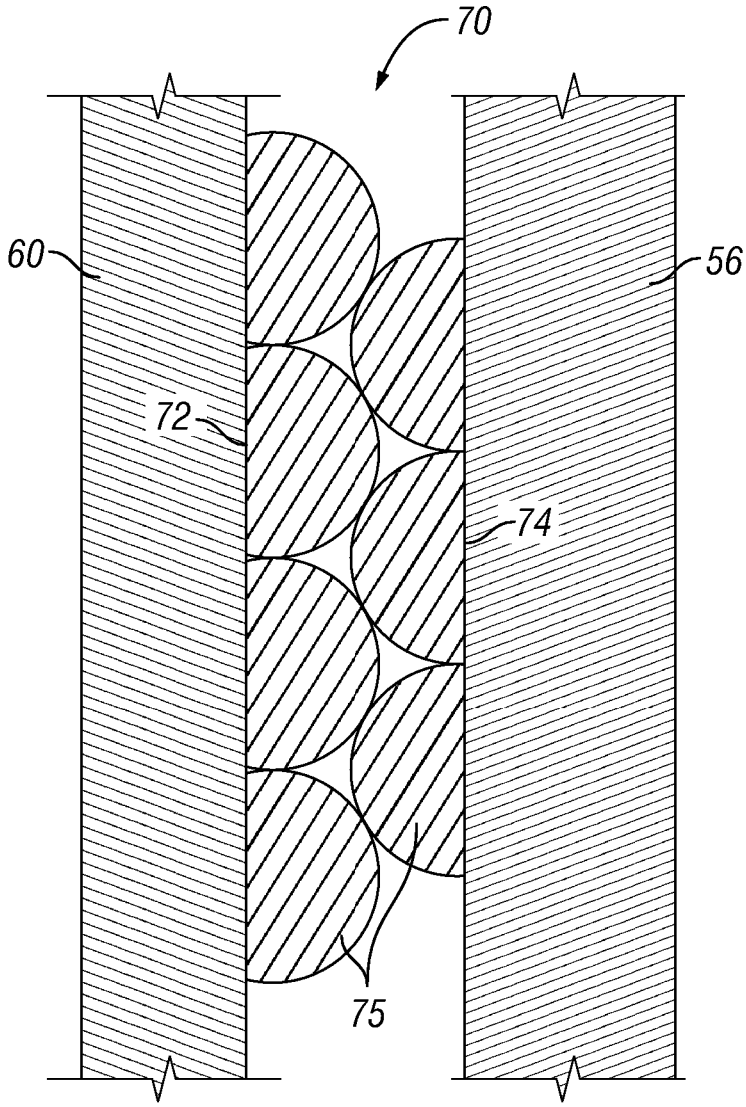
FIG. 5 illustrates one embodiment of a retaining mechanism useful with reclosable valves utilizing the present invention.

FIG. 5 is an illustration of one form of friction structure that may be used as a retention mechanism 70 in a reclosable valve 10. First and second portions 72, 74 are illustrated to comprise a plurality of interfering ribs 75. It will be appreciated that the design parameters for this mechanism will vary depending on downhole conditions and whether well fluid flow tends to open the valve or close the valve.

Returning to FIG. 4, also illustrated in an additional sliding seal 90 located adjacent the retaining mechanism 70 and opposite the portion of the sleeve 60 containing the sealing surface 62. The sliding seal 90 is also preferably made from PEEK material and is held in place by a seal retainer 92. In this embodiment, seal retainer 92 may also comprise the one or more shear pins 80 discussed above. As shown in FIG. 5, the internal sleeve 60 is releasably pinned in the opened position.

Figure 6:
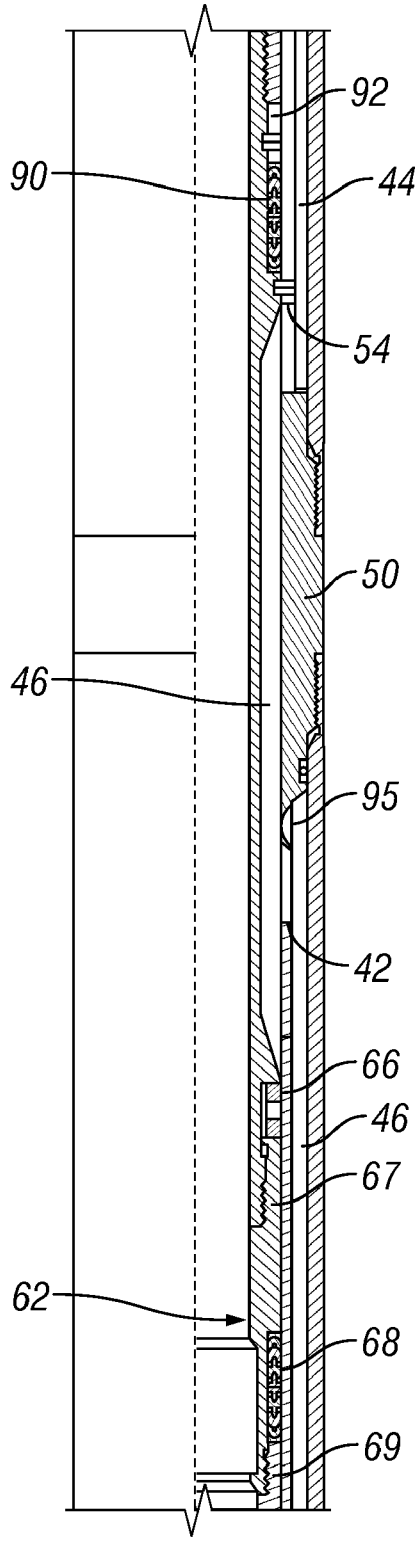
FIG. 6 illustrates another embodiment of a sliding seal useful with the present inventions.

FIG. 6 illustrates another, preferred, embodiment for the sealing surface 62. In this embodiment, the first seal ring 66 may comprise a conventional elastomeric seal element bonded to a backing, such a metal carrier. The elastomeric seal 66 is adapted to slide over, in the embodiment shown in FIG. 4, the lower flow port 42 during the transition of the valve from open to close. Transitioning across the flow ports may comprise the integrity of some seal systems, but the elastomeric seal ring illustrated in FIG. 4 is thought to provide the best solution for sealing integrity and long life. The elastomeric seal ring 66 may be held in place relative to the internal sleeve 60 by seal lock 67. In this embodiment, the second seal ring 68 may comprise a seal pack, such as a CDI OptiPak, fabricated from PEEK, PEKK, PTFE and/or enhanced PTFE. It will be appreciate that in this embodiment, the second seal ring 68 does not have to transition across the lower flow port 42 during opening and closing. Also shown in FIG. 6 are pressure bleed ports 95 that may be used to facilitate closing the valve under pressurized conditions. Once the flow port is closed, the sealing surface 62 spans both the lower flow ports and the pressure bleed ports to close off fluid flow through the valve. FIG. 6 also illustrates another embodiment for the third seal ring 90. In this embodiment, the third seal ring may be the same as or similar to the second seal ring 68, such as the CDI OptiPak seal pack discussed above. As with the second seal ring 68, it will be appreciated that the third seal ring does have to transition across a flow port during opening or closing of the valve and the seal system may be selected based, at least in part, on that criteria.

Figure 7:
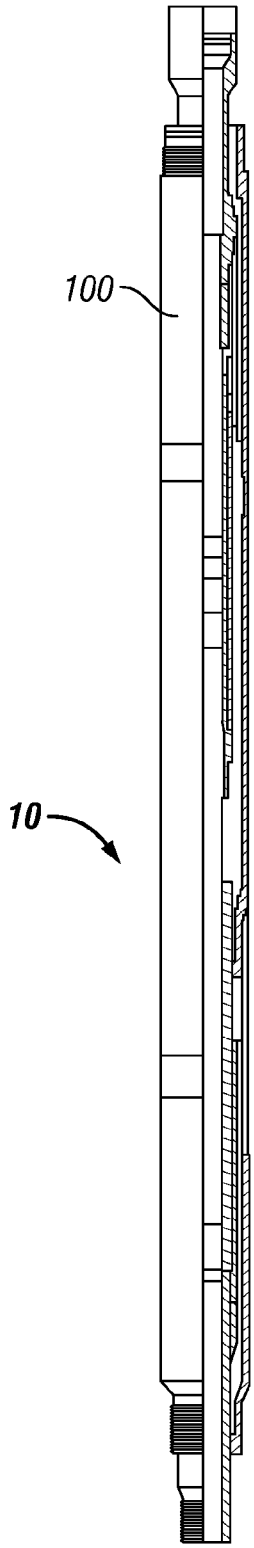
FIG. 7 illustrates a reclosable valve utilizing the present inventions in combination with an interventionless flow control device.

Reclosable valves incorporating the present inventions have wide application in the oil and gas industries. For example, as illustrated in FIG. 7 a reclosable valve 10 according to the present invention may be used in combination with a conventional interventionless flow control device 100 to provide the needed flow isolation, reliability and access to service the well. For purposes of this disclosure, "interventionless" refers to that group of tools, such as flow control devices, that may be actuated by well fluid pressure or differential pressure. For example, BJ Services offers a number of interventionless flow control devices, such as a pressure actuated annular flow valve (marketed as an AFV), a pressure actuated circulation valve (marketed as a PAC valve) or a pressure actuated radial flow valve (marketed as an RFV). There are numerous other interventionless flow control devices offered by others that are suitable for use with the reclosable valve disclosed herein.

For purposes of illustration, the interventionless flow control device 100 in FIG. 6 may be a hydraulically or pressure actuated radial flow valve such as the one offered by BJ Services as the "RFV". The RFV may be coupled to the uphole end of reclosable valve 10. As is conventional, the hydraulic radial flow valve may be initially in its closed configuration. In this circumstance the reclosable valve 10 may have its internal sleeve 60 releasably fixed (for example by shear pins 80) in the opened condition. The combined interventionless and reclosable valve assembly may be run into the well and when production from the subject formation is desired, the operator may interventionlessly open the valve 100 and produce well fluids through the annular flow path of the reclosable valve 10 through the interventionless valve 100 and into the tubing string. Thereafter, the operator may open the well and close off production from the subject formation by transitioning the internal sleeve 60 of the reclosable valve 10 to the closed condition.

Figure 8:
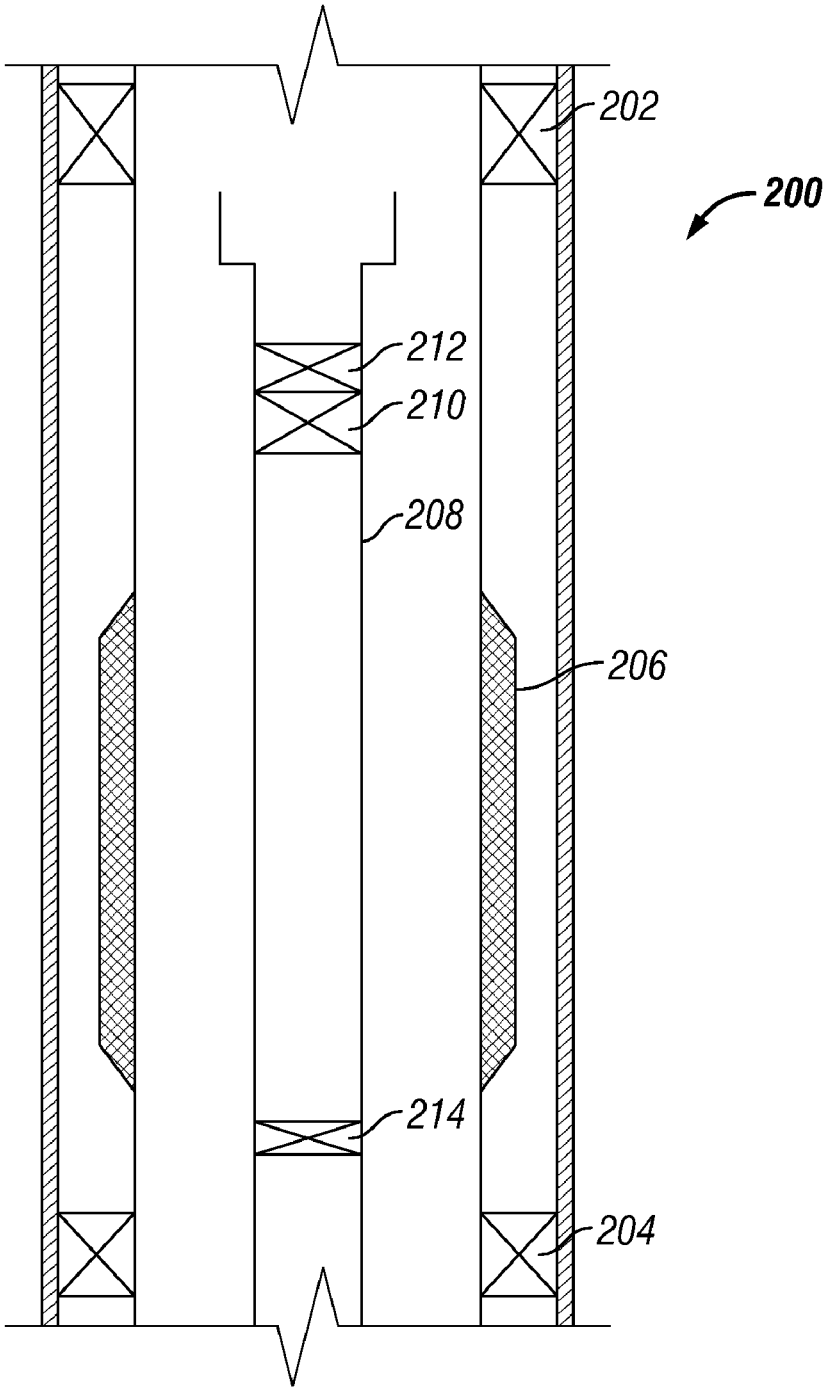
FIG. 8 illustrates a well utilizing a reclosable valve according to the present invention in conjunction with a return or monitoring flow control device, and optionally an interventionless flow control device.

FIG. 8 illustrates one preferred use of a reclosable valve 10 according to the present inventions in a well system. FIG. 8 illustrates a well system 200 comprising upper and lower packers 202, 204 and screen assembly 206. Isolation system 208 is disposed adjacent packer 202, 204 and screen assembly 206, and comprises a reclosable valve 210 embodying one or more of the present inventions. Also illustrated in FIG. 8 is an additional flow control device 214. This additional flow control device may be a conventional mechanical sleeve valve or isolation valve or may be a pressure actuated (interventionless) isolation device. During gravel packing, this additional valve is oftentimes referred to a return valve and during fracture operations, a monitoring valve. Also shown in FIG. 8 is an optional interventionless flow control device 212, such as a BJ Services PAC valve.

It will be understood that the various packers, productions screens, isolations valves, base pipes, isolations pipes, subs, cross-over valves, and seals that may be required for use of the present inventions may be off-the-shelf components as are well known by persons of skill in the art. The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intends to protect all such modifications and improvements to the full extent that such falls within the scope or range of equivalent of the following claims.

What is claimed is:

1. A flow control device for an oil or gas well comprising:

an outer housing;

an inner conduit disposed within the outer housing and fixed relative thereto;

a flow path at least partially defined by an annulus between the outer housing and the inner conduit;

at least one flow port disposed within the flow path for communicating flow along the flow path when the port is open and preventing flow along the flow path when the port is closed;

a sealing member disposed within the device and adjacent the at least one flow port, the sealing member having at least two positions relative to the at least one port including an open position in which the sealing member does not prevent flow through the at least one port and a closed position in which the sealing member prevents flow through the at least one port, the sealing member being configured to be capable of moving from the open position to the closed position so as to reclose the flow control device;

a tool profile disposed on the sealing member for engaging a corresponding profile on a service tool for changing the sealing member from its open to its closed position and vice versa; and an interventionless flow control device coupled to the outer housing comprising a second flow path communicating with first flow path and a valve element that is independent from the sealing member and disposed within the second flow path, the valve element having at least an opened and a closed flow position, such that fluid can flow along the first and second flow paths when the sealing member and valve element are both opened and fluid cannot flow along the flow paths when the sealing member is shifted closed.

2. The device of claim 1, further comprising a retaining mechanism for releasably retaining the sealing member in the open position, the closed position or both positions.

3. The device of claim 2, wherein the retaining mechanism comprises a plurality of interfering ribs, one portion of which are disposed adjacent the sealing member and another portion of which are disposed adjacent the inner conduit.

4. The device of claim 1, wherein the sealing member is an internal sleeve adapted to slide longitudinally relative to the device.

5. The device of claim 4, wherein the internal sleeve further comprises a pair of sealing rings configured to span the at least one flow port when the sleeve is in the closed position.

6. The device of claim 5, wherein the sealing rings are manufactured from a material selected from the group consisting of: an elastomer, PEEK, PEKK and a combination thereof.

7. The device of claim 4, wherein the sleeve is initially releasably fixed to the device in either the opened position or the closed position.

8. The device of claim 1, wherein the flow of fluid through the flow path tends to urge the sealing member into the opened position.

9. The device of claim 1, further comprising a retaining mechanism for releasably retaining the sealing member in the open position and in the closed position.

10. The device of claim 9, wherein the retaining mechanism comprises a plurality of interfering ribs comprising a first portion of said ribs and a second portion of said ribs which are disposed adjacent the sealing member and a third portion of said ribs which are disposed adjacent the inner conduit, the first portion being capable of engaging the third portion for releasably retaining the sealing member in the open position and the second portion being capable of engaging the third portion for releasably retaining the sealing member in the closed position.

11. An interventionless and mechanical flow control assembly having unlimited open and close cycles for an oil or gas well comprising:

an outer housing;

an inner conduit disposed within the outer housing and fixed relative thereto;

a first flow path at least partially defined by an annulus between the outer housing and the inner conduit;

at least one flow port disposed with the first flow path for communicating flow along the first flow path when the port is open and preventing flow along the first flow path when the port is closed;

a sealing member disposed within the device and adjacent the at least one flow port, the sealing member having at least two positions relative to the at least one port including an open position in which the sealing member does not prevent flow through the at least one port and a closed position in which the sealing member prevents flow through the at least one port, the sealing member being configured to be capable of moving from the open position to the closed position so as to reclose the flow control device;

a tool profile disposed on the sealing member for engaging a corresponding profile on a service tool for changing the sealing member from its open to its closed position and vice versa;

an interventionless flow control device coupled to the outer housing and comprising a second flow path communicating with the first flow path, and a valve element disposed within the second flow path and independent from the sealing member, the valve element having at least an opened and a closed position, such that fluid flowing along the first flow path can flow along the second flow path when the valve element is opened and cannot flow along the second flow path when the valve element is closed, the interventionless device adapted to interventionlessly change the flow condition of second flow path in response to well pressure.

12. The assembly of claim 11, wherein the interventionless device is a pressure actuated device selected from the group consisting of: a circulating valve, a radial flow valve, an annular flow valve and a combination thereof.

13. The assembly of claim 11, wherein the interventionless device is initially in the closed position and the sealing member is initially releasably fixed in the open position.

14. The assembly of claim 11, wherein the interventionless device has been pressure actuated and the sealing member has been moved to the closed position.

15. The assembly of claim 14, wherein sealing member has been moved again to the open position.

16. The device of claim 11, further comprising a retaining mechanism for releasably retaining the sealing member in the open position and in the closed position.

17. The device of claim 16, wherein the retaining mechanism comprises a plurality of interfering ribs, a first portion of said ribs and a second portion of said ribs which are disposed adjacent the sealing member and a third portion of said ribs which are disposed adjacent the inner conduit, the first portion being capable of engaging the third portion for releasably retaining the sealing member in the open position and the second portion being capable of engaging the third portion for releasably retaining the sealing member in the closed position.

* * * * *